US005303975A

United States Patent [19]

Asato

[11] Patent Number: 5,303,975

[45] Date of Patent: Apr. 19, 1994

[54] CONVERTIBLE BACKPACK CHAIR

[76] Inventor: Simon Asato, 328 Byron St., Palo Alto, Calif. 94301

[21] Appl. No.: 825,505

[22] Filed: Jan. 24, 1992

[51] Int. Cl.[5] ..... A45F 4/02

[52] U.S. Cl. ..... 297/129; 292/56; 224/155

[58] Field of Search ..... 247/129, 25, 56; 224/155

[56] References Cited

U.S. PATENT DOCUMENTS

| | | | |
|---|---|---|---|
| 1,615,159 | 1/1927 | Bonner | 224/155 |
| 2,031,119 | 2/1936 | Moreland | 224/155 |
| 2,787,316 | 4/1957 | Moore | 297/56 |
| 2,843,185 | 7/1958 | Clem | 297/129 |
| 3,929,373 | 12/1975 | Gawlinski | 297/25 |
| 4,489,866 | 12/1984 | Korte | 247/25 |
| 4,583,778 | 4/1986 | Liebhold | 247/56 |
| 4,676,548 | 6/1987 | Bradbury | 224/155 |
| 4,773,574 | 9/1988 | Burgard | 224/155 |

FOREIGN PATENT DOCUMENTS

| | | | |
|---|---|---|---|
| 2572297 | 5/1986 | France | 297/129 |
| 58080 | 6/1937 | Norway | 224/155 |
| 2128471 | 5/1984 | United Kingdom | 224/155 |

*Primary Examiner*—Flemming Saether
*Attorney, Agent, or Firm*—Jacques M. Dulin; Thomas C. Feix

[57] ABSTRACT

A chair conversion device for a backpack of the type having an external H-bar frame configuration which includes a pair of generally straight tubular side members each of which are pivotally connected adjacent their middle portions to existing side frame members of a provided backpack frame. The tubular side members are swingable through an arcuate range of motion between a first generally upright, storage position to a second open, chair use position. While in the open, chair use position, the bottom end portions of each tubular member form chair rear leg members for the resulting backpack folding chair. A pair of side strap members connect the bottom portions of each chair rear leg member to a bottom portion of the backpack frame to form right and left triangular side supports. An additional transverse strap connects each chair rear leg portion to each other to provide lateral stiffness for the backpack folding chair. A fabric type seat member having side ends folded over and hemmed closed to form loops attaches to and extends between the upper ends of the tubular side members to form the seating surface. In an alternate embodiment the seat member is cut in a trapezoidal configuration and is attached to the upper ends of the tubular side members in a manner such that the long side of a trapezoid forms the leading edge of the seating surface to create a cradle having a greater drop. In another alternate embodiment for the chair conversion device, a single, generally U-shaped tubular frame member is substituted in place of the two tubular side members and transverse strap member arrangement such that a bottom transversely oriented portion of the U-shaped member forms part of the chair rear leg support when the U-shaped frame member is pivoted to the open, chair use position.

10 Claims, 2 Drawing Sheets

CONVERTIBLE BACKPACK CHAIR

FIELD

The present invention relates to improvements in backpacks, and more particularly the invention relates to a simple and lightweight add-on apparatus which permits conversion of a readily available backpack frame to a sturdy camp chair.

BACKGROUND

A backpack of the type intended for use in back country travel and exploration should enable a wearer thereof to carry a sizable load containing needed clothes, food, supplies, etc., on his or her back in comfort for prolonged periods of time. It is also desirable that the backpack frame be strong and fabricated from light weight materials and be designed with backpack loading weight distribution considerations in mind. To this end, backpacks having external H-type frame configurations constructed of sturdy light weight materials, such as tubular aluminum members, have proved very popular.

Although these types of backpacks are comfortable and pleasant to wear for prolonged periods, it is still necessary to take the backpack off from time to time so that the user may sit down and rest his or her legs. For such situations, it is desirable to provide an above ground chair having a back rest so that the backpacker can comfortably sit in a reclined position without soiling his or her trousers.

The prior art is replete with backpacks which describe the use of a multi-part backpack frame wherein a portion of the frame articulates to permit conversion of the backpack frame into a camp chair. U.S. Pat. Nos. 4,300,707 (Kjaer) and 4,720,029 (Varanakis) are examples of one type of backpack/chair conversion wherein a first generally upright rectangular backpack frame member has pivotally connected thereto the terminal free ends of a second U-shaped frame member which, when pivoted through a rearward arcuate direction (i.e., through an arcuate direction away from the wearer's back) forms the seat portion of a chair. In the chair use position, the pack must be removed from the backpack frame before the user may sit down into the converted chair.

U.S. Pat. Nos. 4,450,990 (Bolstad) and 4,487,345 (Pierce et al.) are examples of a second type of convertible backpack chair wherein the loaded pack is left on the backpack frame during the chair conversion process. The Bolstad patent teaches to covert his backpack frame into a chair by partial disassembly, reorientation and reassembly of some of the component parts of the backpack frame. This approach adds undesirable complexity and weight to the backpack frame.

Pierce is directed to a chair convertible backpack frame which includes a plurality of pivotally connected frame subassemblies which articulate outwardly in an accordion-type fashion to form a low lying parallelogram chair support structure complete with arm rest. The parallelogram support structure, while sturdy, adds a significant amount of additional weight to the backpack frame.

U.S. Pat. No. 4,795,068 issued to Blean discloses a backpack chair wherein a single U-shaped frame member is pivotally attached to the upright side members of a backpack frame. The U-shaped frame member cooperates with the adjustable shoulder straps of the backpack frame to form a seat when pivoted to a position orthogonal to the vertical axis of the backpack frame. The bottom portion of the vertical backpack frame forms the front leg support for the chair while support for the rear leg is formed by leaning the backpack against the nearest firm vertical surface, such as a tree or rock. Although implementation of the additional U-shaped frame member with an existing backpack frame is simple and adds minimal extra weight, its utility as a convertible backpack chair is limited to specific site locations, i.e., limited only to those sites having a suitable vertical support surface close by.

Accordingly, there is a definite need in the art for a self supported convertible backpack chair which is of light weight construction and is easy to implement.

OBJECTS

It is a principal object of the present invention to provide a readily available backpack of the type having a standard H-bar frame configuration with a add-on unit for converting the backpack frame into a comfortable, strong, and lightweight camp chair;

It is another object of the invention to provide a backpack chair conversion device of said type which comprises a minimum number of additional parts and pivots closed to a stored out of the way position when not in use;

It is another object of the invention to provide such a backpack chair conversion device which is pivotally attached to the existing holes and the tubular support members of readily available backpack frames and wherein the backpack frame conversion device forms a foldable chair similar to a director's chair when operated in its open or use position;

It is another object of the invention that the convertible backpack chair add-on device is collapsible for storage in an upright out of the way position when not in use;

Still further other objects will become evident from the following description and drawings and from the appended claims.

DRAWINGS

SUMMARY

Figure 1:
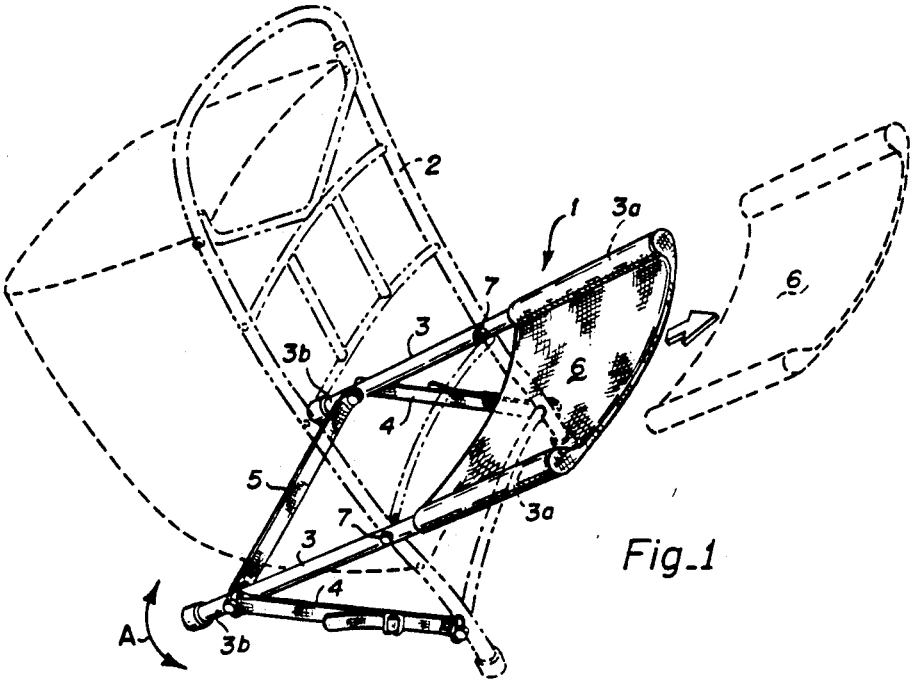
FIG. 1 is an isometric view of one embodiment of the folding chair backpack conversion device showing its functional use position as a chair (backpack and backpack frame shown in phantom)

The invention provides a useful way for converting a conventional external frame, H-bar configuration backpack, into a comfortable and sturdy camp chair. The chair conversion device comprises a pair of tubular side members which are pivotally connected to the side frame members of the provided backpack frame. Pivot connection is accomplished by a simple nut and bolt or clevis pin arrangement which connects a mid-region of each tubular member to the existing transverse through-holes of the backpack frame side members. These through-holes are originally provided for the positioning of the pack and back support members along the backpack frame. The tubular side members are moveable between a first stored position and a second chair use position. When in the chair use position, the bottom end portions of the tubular side members form the chair rear leg supports and the lower portion of the backpack frame side members (below the pivot point) form the front leg supports. In turn, the top end portions of the tubular side frame members form the side supports for a chair seating surface.

In the preferred embodiment, the tubular side members are pivotally connected at transverse holes which are located in the range of from about 10 to about 12 inches from the bottom end of each backpack side frame member. The pivot point location provides a height dimension for the chair front leg supports sufficient to permit a user to easily sit down on and get up from the resulting seating surface.

Adjustable side straps connect the bottom end portions of the rear chair leg supports (i.e., the bottom end portions of each tubular side member) with the bottom end portions of the backpack frame side members to provide a pair of stable triangular chair leg side supports. A transverse strap member is also provided which connects the chair rear leg portions of each tubular side member to provide sufficient rigidity and lateral stiffness to the folding chair.

A generally rectangular seat member made of a flexible cloth such as canvas or other like fabric is attached to the upper free ends of the tubular side members to provide a comfortable seating surface. To this end, the opposed side ends of the seat member are folded over and sewn onto the fabric center portion to form loops for fitting over the free ends of the upper end portions of the tubular side members. Alternately, the seat fabric may have dowels already sewn into the material and whereby the dowels are disposed to engage slots formed in the chair frame.

In one embodiment for the seat member, the cloth may be cut in an exaggerated trapezoidal configuration such that the long side of the trapezoid forms the leading edge of the seating surface. In this manner, a substantially horizontal positioning for the seating surface may be achieved which results in greater comfort to the user since his or her legs are supported in a natural position.

In an alternate embodiment for the chair conversion device the tubular side members and transverse strap are replaced by a single, generally U-shaped tubular member wherein the elongated side portions of the U-shaped frame member are pivotally connected to the backpack frame side members in the manner as above described. When moved to its open chair use position the bottom transverse tubular member portion of the U-shaped frame member also forms a portion of the chair rear leg support. The transverse bridge portion and tubular portion of the U-shaped frame member are linked by a bend portion which displaces the transverse bridge portion vertically downward relative to the connection point between the connecting side strap and the bottom portion of the elongated tube member. The bend portion, in effect, rotates the vertical axis of the backpack frame forward a small distance to provide a more level seating surface for the user. In view of the inward projection of the transverse bridge portion which arises during the storage position (i.e., when the U-shaped frame member is pivoted closed such that the elongated tubular portions and backpack frame side member are substantially side-by-side) it is desirable to provide each bend portion with an additional curve to move inwardly the transverse tube member portion of the U-shaped member horizontal a sufficient distance so that it lies in the same plane as the generally vertical elongated side members when viewed from the side. In this way, there is no hindrance to the leg and hip movement of the backpack wearer.

A clip member, preferably made from a molded thermoplastic, is provided to retain the tubular side members (or elongated side portion in the alternate embodiment) to the backpack frame when the folding chair backpack is in its stored position.

The folding chair conversion apparatus is easy to use and easy to implement and quickly collapses to the stored position when the backpack folding chair is lifted off the ground.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

A folding chair backpack conversion apparatus constructed in accordance with one embodiment of the present invention is shown in FIG. 1 and designated generally by numeral 1. The folding chair backpack conversion apparatus 1 comprises a pair of tubular side members 3, a pair of side straps 4, a transverses strap 5 and a seat member 6. In an alternate embodiment, the side straps 4 and the transverse strap 5 may be formed as a single continuous strap member.

Each side member 3 has a first seat side support end 3*a* and a second chair rear leg support end 3*b*. The side members are pivotally connected by a simple nut and bolt arrangement to holes 7 provided in the side frame support members of a provided backpack frame 2. In the preferred best mode embodiment, the provided backpack frame 2 is of an external H-bar configuration frame constructed of one inch outer diameter tubular aluminum stock. These types of backpack frames have a plurality of spaced-apart transverse through-holes 7 provided along their upright side frame members for multi-positional placement of a pack or back rest/support member thereon. Accordingly, the tubular side members may be pivotally connected to selected ones of the existing through-holes 7 without modification to the backpack frame 2.

To assemble the invention, appropriate through-holes 7 are selected for pivotally mounting the tubular side members 3 thereto in the manner as above described. Any clevis pins used to secure the pack or back rest support member are removed and replaced by the nut and bolt assembly used to connect the tubular side members 3 to the backpack frame 2. While the above description makes reference to a simple nut and bolt assembly for connecting the structural members of the seat assembly to the back-pack frame, it is understood that other known vertical connectors, such as for example, clevis pins, may be used with equally good results.

Figure 4:
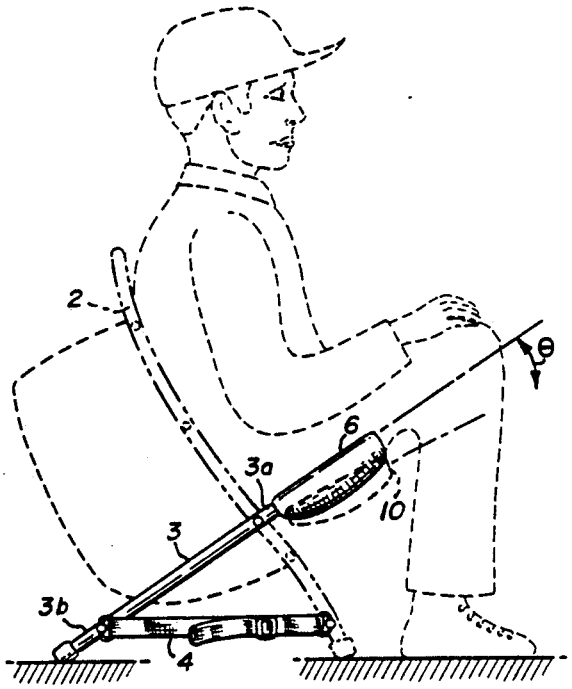
FIG. 4 is a side elevation view of the invention showing the first unfolded or use position of the folding chair backpack conversion apparatus.

Since the tubular side members 3 are connected at or near their mid-portions, they form both the rear chair leg supports and the seat side supports for a folding chair when pivoted open to their use position as shown in FIGS. 1 and 4. In this manner, a reduction of component parts has been achieved in converting a backpack into a chair since the backpack frame 2 forms the front leg supports for the chair. In the preferred best mode of the invention, the distance of the selected holes 7 from the bottom ends of the backpack frame 2 is in the range of about 10–12 inches. This distance provides a sufficient vertical rise for the seating surface and results in a stable folding chair when matched with appropriately selected lengths for the tubular side members 3 and side straps 4.

The side straps 4 connect the rear leg chair support end portions 3*b* of tubular side members 3 to corresponding left and right side bottom frame portions of the provided backpack frame 2 to form left and right triangular base side supports, respectively, for the backpack folding chair. Any known bolt or clevis pin arrangements may be used for attaching the straps 4 to the tubular side members 3 and backpack frame 2. The straps 4 are preferably adjustable to form a wider or narrower base for the triangular side supports for the folding chair arrangement.

Transverse strap 5 connects the rear leg chair support end portions 3*b* of the tubular side members 3 and provides sufficient lateral base support for the resulting folding chair. As is the case for the two side straps 4, it is understood that any number of known means for securing or anchoring the transverse strap 5 to the tubular side members 3 may be used, including but not limited to pins, nut and bolt arrangements, VELCRO TM - type loop and hook fasteners, and buckle enclosures.

The seat member 6 comprises a generally rectangular piece of flexible cloth or other suitable cloth-like material and includes side edges which are folded back and sewn onto the body portion of the cloth to form an open pair of tube-like hems each having an opening sufficient to slide over the seat side support ends 3*a* of the tubular side members 3.

Figure 2:
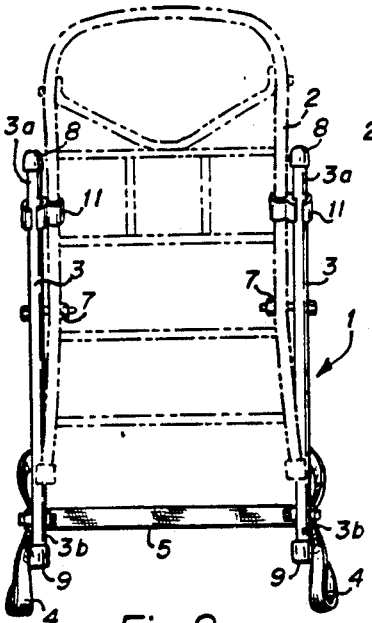
FIG. 2 is a front elevation view of the embodiment shown in FIG. 1 illustrating the upright folded or stored position of the folding chair backpack conversion apparatus.
Figure 3:
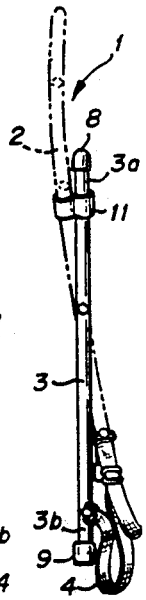
FIG. 3 is a left side elevation view of FIG. 2.

FIGS. 2 and 3 show the folding chair backpack conversion apparatus 1 in a second or stored position wherein the seat side supports 3*a* of the tubular side members 3 are fastened to the backpack frame 2 by a fastener means 11. In the preferred embodiment, the fastener means comprises a molded thermoplastic holder piece which is formed as two snap-fit tubular members coupled together by a webbing structure. It is understood that any number of other known arrangements for fastening these tubes together may be used in combination with the present invention including, but not limited to VELCRO TM -type hook and loop fasteners, strap and buckle arrangements, and the like.

To provide a finished look to the tubular side member 3, the ends of the chair seat side supports 3*a* are capped at 8 and the ends of the chair rear leg supports 3*b* are capped at 9.

Figure 5:
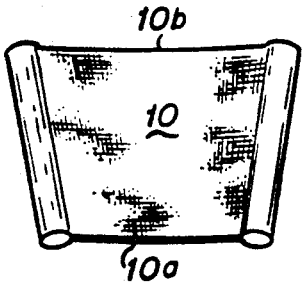
FIG. 5 is a top plan view of the seat member illustrating a trapezoidal cut to permit a substantially horizontal seat position.

Referring to FIG. 4, a use position of the folding chair backpack conversion apparatus 1 is shown wherein a person is seated on the seating surface afforded by the attachment of the seat member 6 to the free ends of the chair seat side supports 3*a*. The angle represents a range of inclines for the seating surface which results from altering the geometry of the seat member 6. For example, referring to FIG. 5, a trapezoidal seat member 10 provides a flatter or more horizontal position of the seating surface when the short side 10*a* of the trapezoid 10 is oriented adjacent the backpack frame 2. In other words, the longer side 10*b* of the trapezoidal seat member 10 permits a wider cradle or drop which results in a more comfortable support position for the user's legs. The dimensions for the trapezoidal seat member 10 may be varied to achieve a desired incline for the seating surface according to the exact height location selected along the backpack frame 2 for pivotal connection of the side members 3.

Figure 6:
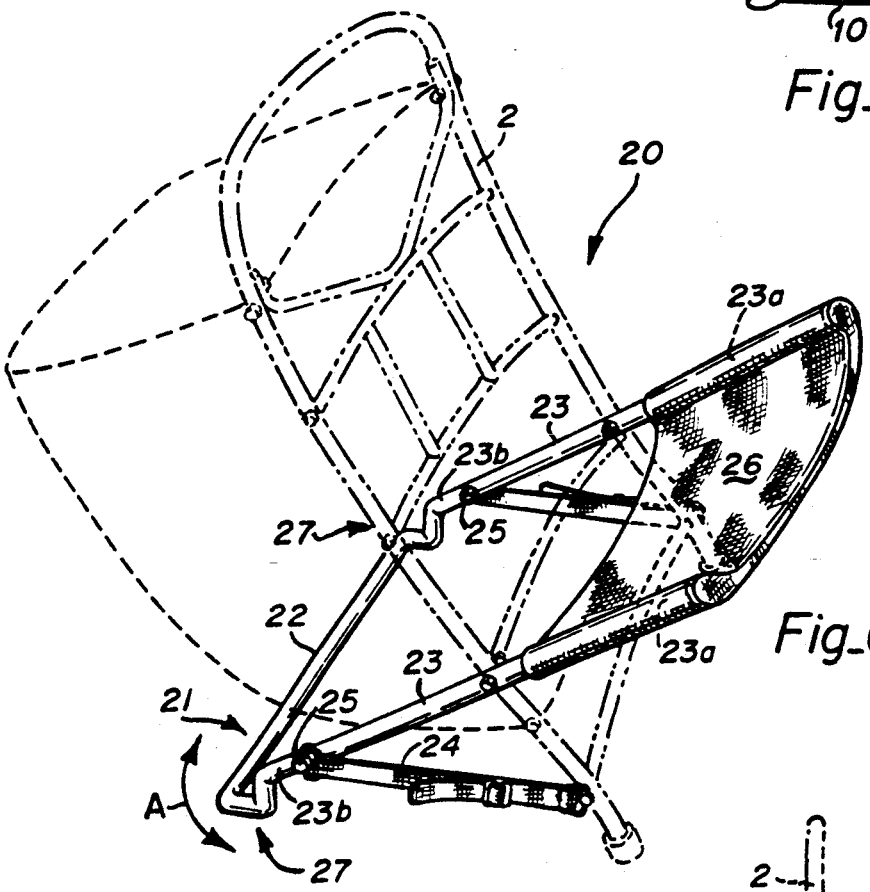
FIG. 6 is an isometric view alternate embodiment for the folding chair backpack conversion apparatus of the present invention.
Figure 7:
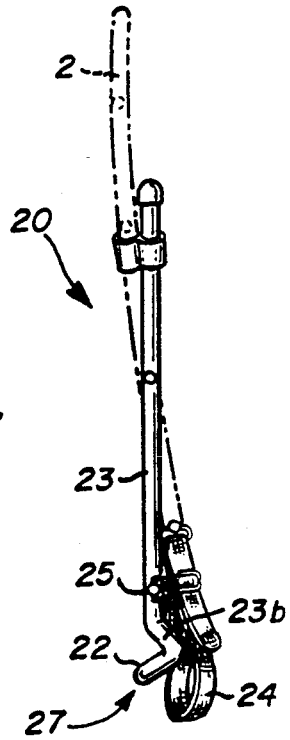
FIG. 7 is a right side elevation view of the alternate embodiment of FIG. 6.

FIGS. 6 and 7 show an alternate embodiment 20 for the folding chair/backpack conversion apparatus. In this embodiment, the flexible transverse strap 5 is replaced by a solid tubular transverse member. As is best seen in FIG. 6, the side tubular members now form the elongated end portions 23 of the generally U-shaped tubular frame member 21.

As before, the elongated end portions 23 are pivotally connected at or near their mid-length portions to the provided backpack frame 2 in the manner as above described with references to FIGS. 1–4, so that the free end portions 23*a* form the chair seat side supports for seat member 26 when the U-shaped frame member 21 is moved in the direction as indicated by Arrow A to its open, chair use position. The location of the pin connector 25 between the side straps 24 to the chair rear leg end portions 23*b* are just above the bend regions 27 so that the triangular side support arrangement formed by the elongated members 23, side straps 24 and the bottom side frame portions of the backpack frame 2 is maintained.

The bend regions 27 sweep back in a downwardly and outwardly curved fashion and are linked together by the transverse member portion 22. As is best seen in FIG. 7, the downward and rearward bend regions 27 displace the transverse member portion 22 a sufficient distance backward relative to the vertical axis of the backpack frame 2 so as not to interfere with any existing backpack frame attachments (such as back or hip rest members) or hinder the user's hip or leg range of motion while walking with the backpack on his or her back.

It should be understood that various modifications within the scope of this invention can be made by one of ordinary skill in the art without departing from the spirit thereof. I therefore wish my invention to be defined by the scope of the appended claims as broadly as the prior art will permit, and in view of this specification as need be.

I claim:

1. An improved chair conversion device for a backpack of the type having an external H-bar frame configuration which includes a pair of generally vertical tubular left and right side backpack frame members each side frame member having a plurality of spaced apart transverse through-holes disposed along a longitudinal axis thereof for receiving clevis pins or like hardware for retaining pack and back rest support members, the improvement comprising in operative combination:

a) a pair of generally straight tubular side members each of which being pivotally connected adjacent a middle portion thereof to existing transverse through-holes of corresponding left and right backpack frame side members of a provided backpack, said tubular side members swingable through an arcuate range of motion between a first generally upright, storage position and a second open, use position, each of said tubular side members includes:

i) a first forward end portion defining a chair seat side support member when said tubular side members are moved to said use position;

ii) a second rearward end portion defining a chair rear leg support member when said tubular side members are moved to said use position;

b) a pair of length adjustable side strap members, each of said side strap members connecting each of said rear leg support members to a corresponding bottom side portion of said backpack frame side members to form left and right side triangular leg supports for said backpack chair when said tubular side members are moved to said use position;

c) a removable transverse strap member connected to and extending between each of said chair rear leg support members;

d) a flexible seat member removably attachable to and for extending between said chair seat side support members when said tubular members are pivoted to said use position; and wherein i) said flexible seat member is generally trapezoidal in plan view having a first short side edge and a second longer side edge; and ii) said first short side edge is oriented adjacent said backpack and said second longer side edge forms a leading chair seat edge when said seat member is attached to said chair seat side supports to permit a substantially horizontal position for a user's legs when seated in said backpack chair.

2. An improved backpack chair conversion device as in claim 1 which includes means for fastening said tubular side members to said backpack frame when said tubular members are in said stored position.

3. An improved backpack chair conversion device as in claim 1 which includes means for fastening said tubular side members to said backpack frame when said tubular members are in said stored position.

4. An improved backpack chair conversion device as in claim 3 wherein:

a) said side strap and said transverse strap are permanently connected to said rear leg support members.

5. An improved backpack chair conversion device as in claim 1 wherein:

a) said side strap and said transverse strap are permanently connected to said rear leg support members.

6. An improved chair conversion device for a backpack of the type having an external H-bar frame configuration which includes a pair of generally vertical outer tubular left and right side frame members each side frame member having a plurality of spaced apart transverse through-holes disposed along a longitudinal axis thereof for receiving clevis pins or like hardware for retaining pack and back rest support members, the improvement comprising in operative combination:

a) a first, generally U-shaped tubular frame member having a pair of generally straight elongated members connected together at bottom end portions thereof by a single transverse member, each of said elongated members being pivotally connected adjacent a middle longitudinal length portion thereof to existing transverse through-holes of corresponding left and right side frame members of a provided backpack frame, said U-shaped member swingable through an arcuate range of motion between a first generally upright, storage position and a second open, use position, wherein:

i) each of said elongated member bottom end portions and said transverse member form a chair rear leg support and said backpack frame forms a chair front leg support for a resulting backpack chair when said U-shaped member is moved to said second, use position;

b) a pair of length adjustable side strap members, each of said side strap members having removably connectable end portions including a first end portion connected to said U-shaped tubular frame member at said bottom end portions of each of said elongated members and a second end portion connected to corresponding bottom left and right side edge portions of said backpack frame; and c) a flexible seat member removably attachable to and for extending between free end portions of said elongated members of said U-shaped tubular frame member to form a seating surface when said U-shaped tubular frame member is pivoted to said open, use position; and wherein:

i) said flexible seat member is generally trapezoidal in plan view having a first short side edge and a second longer side edge; and ii) said first short side edge oriented adjacent said backpack and said second longer side edge forming a leading chair seat edge when said seat member is attached to said chair seat side supports to permit a horizontal positioning of a user's legs when seated in said backpack chair.

7. An improved backpack chair conversion device as in claim 6 which includes means for fastening said tubular side members to said backpack frame when said tubular members are in said stored position.

8. An improved backpack chair conversion device as in claim 6 which includes means for fastening said tubular side members to said backpack frame when said tubular members are in said stored position.

9. An improved backpack chair conversion device as in claim 8 wherein:

a) said side strap members are permanently connected to said U-shaped frame member and said backpack frame.

10. An improved backpack chair conversion device as in claim 6 wherein:

a) said side strap members are permanently connected to said U-shaped frame member and said backpack frame.

* * * * *